US009305739B2

(12) United States Patent
Legall et al.

(10) Patent No.: US 9,305,739 B2
(45) Date of Patent: Apr. 5, 2016

(54) APPARATUS FOR ULTRA HIGH VACUUM THERMAL EXPANSION COMPENSATION AND METHOD OF CONSTRUCTING SAME

(71) Applicant: General Electric Company, Schenectady, NY (US)

(72) Inventors: Edwin L. Legall, Florence, SC (US); Ryan Mitchell Damm, Theresa, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 238 days.

(21) Appl. No.: 13/652,598

(22) Filed: Oct. 16, 2012

(65) Prior Publication Data

US 2014/0105365 A1 Apr. 17, 2014

(51) Int. Cl.
*H01J 35/10* (2006.01)

(52) U.S. Cl.
CPC ..... *H01J 35/101* (2013.01); *H01J 2235/1006* (2013.01); *H01J 2235/1208* (2013.01)

(58) Field of Classification Search
USPC ..... 378/125, 127, 130; 445/28
See application file for complete search history.

(56) References Cited

U.S. PATENT DOCUMENTS

| | | | | |
|---|---|---|---|---|
| 5,978,447 | A * | 11/1999 | Carlson | H01J 35/101 378/127 |
| 7,067,964 | B1 * | 6/2006 | Kosinski | H03H 9/1035 310/348 |
| 2008/0056450 | A1 * | 3/2008 | Joshi | H01J 35/101 378/132 |
| 2010/0322383 | A1 | 12/2010 | Coon et al. | |

* cited by examiner

*Primary Examiner* — Phillip A Johnston
*Assistant Examiner* — Hsien Tsai

(57) ABSTRACT

An x-ray tube includes a frame forming a first portion of a vacuum enclosure, a rotating subsystem shaft positioned within the vacuum enclosure and having a first end and a second end, wherein the first end of the rotating subsystem shaft is attached to a first portion of the frame, a target positioned within the vacuum enclosure and attached to the rotating subsystem shaft between the first end and the second end, the target positioned to receive electrons from an electron source positioned within the vacuum enclosure, and a thermal compensator mechanically coupled to the second end of the rotating subsystem shaft and to a second portion of the frame, the thermal compensator forming a second portion of the vacuum enclosure.

19 Claims, 6 Drawing Sheets

APPARATUS FOR ULTRA HIGH VACUUM THERMAL EXPANSION COMPENSATION AND METHOD OF CONSTRUCTING SAME

BACKGROUND OF THE INVENTION

Embodiments of the invention relate generally to x-ray tubes and, more particularly, to an apparatus for forming an expansion joint and a method of constructing same.

Computed tomography (CT) X-ray imaging systems typically include an x-ray tube, a detector, and a gantry assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector converts the received radiation to electrical signals and then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

A typical x-ray tube includes a cathode that provides a focused high energy electron beam that is accelerated across a cathode-to-anode vacuum gap and produces x-rays upon impact with an active material or target provided. Because of the high temperatures generated when the electron beam strikes the target, typically the target assembly is rotated at high rotational speed for purposes of cooling the target. Components of the x-ray tube are placed in a ultra-high vacuum which is maintained by a frame that is typically made of metal or glass.

The x-ray tube also includes a rotating subsystem that rotates the target for the purpose of distributing the heat generated at a focal spot on the target. The rotating subsystem is typically rotated by an induction motor having a cylindrical rotor built into an axle that supports a disc-shaped target and an iron stator structure with copper windings that surrounds an elongated neck of the x-ray tube. The rotor of the rotating subsystem assembly is driven by the stator. Typically, the target is supported by a bearing assembly in a cantilever type arrangement. The bearing assembly is comprised of a front inner/outer bearing race and a rear inner/outer bearing race, ball bearings, and a shaft extends therefrom to support the target. The bearing assembly is axially anchored on one end such that, in a typical design the shaft supporting the target is able to expand and contract freely during operation and as a result of the extreme temperatures experienced during operation.

In recent years, it has been desired within the CT industry to increase gantry speeds to 0.4 seconds gantry rotation and faster. As the industry drives to faster gantry speeds, the mechanical loading on x-ray tubes has increased as well. Generally the mechanical loading on an x-ray tube increases as the square of the gantry rotational speed, thus increased gantry speeds have lead to enormous g-loading on the x-ray tube and particularly on the target. Accordingly, the mechanical loading on the support bearing assembly of the target has increased dramatically as well.

As such and in order to accommodate the increased gantry speeds, in some known designs the target is supported by a single shaft, but a flange is incorporated that enables the target to be positioned between the front and rear races of the bearing assembly (sometimes referred to as a reentrant design). This positions the target proximate to both the front and rear races, and in some known designs the target is positioned such the center of gravity of the rotating subsystem is centered between the front and rear races, which enables equal load sharing between the front and rear races. In other known designs a spiral groove bearing (SGB) may be incorporated, in lieu of ball bearing-based bearing assemblies, that provides a much broader distribution of stress over a low vapor fluid (liquid metal fluid) that is positioned between inner and outer components that rotate with respect to one another under a relatively small gaps, approximately 15 microns in one known embodiment. One known fluid in a SGB is gallium.

However, it has been desired in recent years to increase gantry speeds yet more, to 0.25 gantry speeds and faster. As such, known bearing designs may fail either catastrophically or through a shortened life due to wear in these increased g-load conditions. Increased gantry speeds can also cause relatively large mechanical deflections of the target support structure (shaft, bearing & target) that can cause focal spot motion or other sources of image quality problems. Thus, in order to enable operation in 0.25 seconds gantry speed and faster, recent x-ray tube designs have included a shaft that is supported on both axial sides of the target. That is, the rotatable shaft to which the target and rotor are attached may include a bearing stationary support (ball-bearing or SGB, as examples) that is hard connected to a plate or other support structure of the x-ray tube. In other words, in order to accommodate the dramatically increased loads for gantry speeds of 0.25 seconds or greater, it is desirable to support the target with supports that are positioned on both sides of the target, providing a 'straddle' support that significantly reduces the concentrated load and deflection on the bearing and removes the cantilever affect of a cantilever-mounted target.

However, in order to do so (that is, to provide the second support) the second support is typically hard mounted to the frame of the x-ray tube. As such, the support mechanically constrains the shaft axially on its second end as well, precluding the shaft from being able to freely expand and contract during operation and during other heating and cooling events.

Typically the components of the x-ray tube are made of different materials for different reasons. For instance, the shaft itself is often made of molybdenum (because of its ability to sustain high temperatures during operation), while the support plate and frame to which the shaft is attached is typically made of a far less expensive material such as stainless steel. Because of the mismatched coefficients of thermal expansion (CTE) and weldability, as examples, kovar is typically included as an interim material between the shaft and the support plate. The frame itself, attached to the support plate and used to enclose the target, rotor, and other components, may be made of 304L, for example. As such, for a variety of reasons that include but are not limited to material cost, processing and machining expense, performance (i.e., high temperature operation), and weldability, a variety of materials is typically used to form the shaft, plate, frame, and other components that support and enclose the target. Because each material has its own axial length, CTE, overall operating temperature and because the shaft is hard mounted at both ends, differential thermal growth can induce high stresses at interfaces (in welds and brazes) and component parts for the variety of thermal conditions experienced.

Because of the very high processing and operating temperatures in x-ray tubes, x-ray tube components such as the target and its supporting shaft are made with refractory metals such as Molybdenum. Molybdenum is characterized by a low coefficient of thermal expansion (CTE) compared to ferrous metals. The supporting shaft is itself supported and enclosed by the vacuum frame and a support plate, which are generally made from an austenitic stainless steel (304), which has a CTE that is approximately three times that of Molybdenum or alloys thereof. Thus, although the target, the supporting shaft, and the vacuum frame and the support plate may not be made of these specific materials, they are nevertheless typically made of materials in which a large CTE difference occurs at interfaces. The differences of material CTEs and the overall length of the relatively large parts can cause large differential thermal growth between the shaft and its linked components. When combined also with a typically relatively high component stiffness for load capability and deflection control, high internal stresses can be induced at the component interfaces that may include weld and braze joints. The weld or braze joints therefore can present modes of failure that may include a vacuum leak at the joint or a mechanical joint failure that can even lead to a catastrophic tube failure.

As such, one known method of reducing stresses in the components and interfaces is to selectively design the components such that the changes in lengths, that result from temperature changes, balance one another (zero differential thermal growth). That is, based on a thermal model, temperature distributions of the component parts may be predicted and then materials and component related geometric length can be selected such that they balance the changes in lengths that can occur as a result of the predicted temperature distributions. For instance, during operation the center shaft made of Molybdenum, although having a lower expansion coefficient than the 304L frame material, the center shaft may nevertheless expand more than the frame because of the much higher temperature at which it the center shaft operates. Thus, in this example, in order to counteract the effect, a material having a higher CTE than 304 L can be included in a portion of the frame (reentrant rotor) such that the parts expand the same amount when the component parts reach their steady state operating temperature. Also nickel based alloys such as Ni42 with lower CTE than SS304L or a hybrid frame assembly made of ceramic, kovar, or nickel base alloys could be used in the frame construction to reduce the overall component thermal growth.

However, although component parts can be designed that minimize the stresses that result at temperature, not all thermal conditions are the same for the x-ray tube. For instance, x-ray tubes operate at a wide range of steady state or average powers, thus one set of assumed steady state thermal conditions may not suffice to minimize stress in the components when a different steady state occurs. One day may see a lot of high power imaging with a heavy patient load, while on other days only low power scans may be conducted. Further and regardless, while heating and cooling, the components experience transient thermal responses (temperature distributions) that can cause stresses to occur, due to differential dynamic expansion during the transients, that can cause stresses to occur even if the stresses are reduced to near zero when they do reach steady state.

In addition, aside from the extreme temperatures experienced during typical x-ray tube operation, during manufacture the x-ray tube may go through significant temperature excursions during processing such as bakeout and seasoning. As one example, during bakeout the entire x-ray tube (frame, support plate, shaft, etc. . . . ) is brought to a high temperature (approximately over 400° C.). Typically, the x-ray tube is baked in an oven in order to bring all component parts up to sufficient temperature so as to clean all the exposed surfaces and provide longterm high voltage stability. During bakeout the frame in particular experiences a much higher temperature excursion that typically occurs during normal operation in an x-ray tube. As such, even if component parts are designed in order to survive various steady state and transient conditions, bakeout and other processing steps can cause worse differential thermal growth than those under tube operating conditions.

Thus, when both ends of the stationary shaft of the rotating subsystem are hard mounted to the frame, enormous stresses can result at the component interfaces and at the component itself as the overall system heats due to processing or operating thermal condition from room temperature. The stresses can be reduced to an extent by designing components appropriately such that interfaces and component stresses are within design limits for a given set of thermal conditions. However, an x-ray tube can see a wide variety of steady state and transient conditions, as well as different operating conditions. As such, not all possible sets of thermal conditions can be designed for, and component stresses can occur that can lead to fatigue cycling and/or catastrophic component failure.

Accordingly, it would be advantageous to have an x-ray tube having a robust design with joints between components that can maintain an ultra-high vacuum under a wide range of thermal conditions during operation and processing and overcome the aforementioned drawbacks.

BRIEF DESCRIPTION

Embodiments of the invention provide an apparatus and method of constructing an apparatus that overcomes the aforementioned drawbacks and maintains an ultra-high vacuum required by the x-ray tube to operate, with low mechanical stresses at the component interfaces.

According to one aspect of the invention, an x-ray tube includes a frame forming a first portion of a vacuum enclosure, a rotating subsystem shaft positioned within the vacuum enclosure and having a first end and a second end, wherein the first end of the rotating subsystem shaft is attached to a first portion of the frame, a target positioned within the vacuum enclosure and attached to the rotating subsystem shaft between the first end and the second end, the target positioned to receive electrons from an electron source positioned within the vacuum enclosure, and a thermal compensator mechanically coupled to the second end of the rotating subsystem shaft and to a second portion of the frame, the thermal compensator forming a second portion of the vacuum enclosure.

In accordance with another aspect of the invention, a method of manufacturing an x-ray tube includes forming a first portion of a vacuum enclosure with a frame, attaching a first end of a rotating subsystem shaft to the frame, coupling a second end of a thermal compensator to the frame, wherein the thermal compensator forms a second portion of the vacuum enclosure, and mechanically coupling a first end of the thermal compensator to a second end of the target support shaft by the rotor can or other component attachment.

Yet another aspect of the invention includes an imaging system that includes a support structure, a detector attached to the support structure, and an x-ray tube attached to the support structure. The x-ray tube includes a vessel forming a portion of a vacuum enclosure, a rotating subsystem shaft positioned within the vacuum enclosure and having a first end and a second end, wherein the first end of the shaft is attached to a portion of the vessel, a target in the vacuum enclosure that is attached to the rotating subsystem shaft between the first end and second ends, the target positioned to receive electrons from a cathode positioned within the vacuum enclosure, and a thermal compensator mechanically coupled to the second end of the shaft and to another portion of the vessel, the compensator forming another portion of the vacuum enclosure.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION

Figure 1:
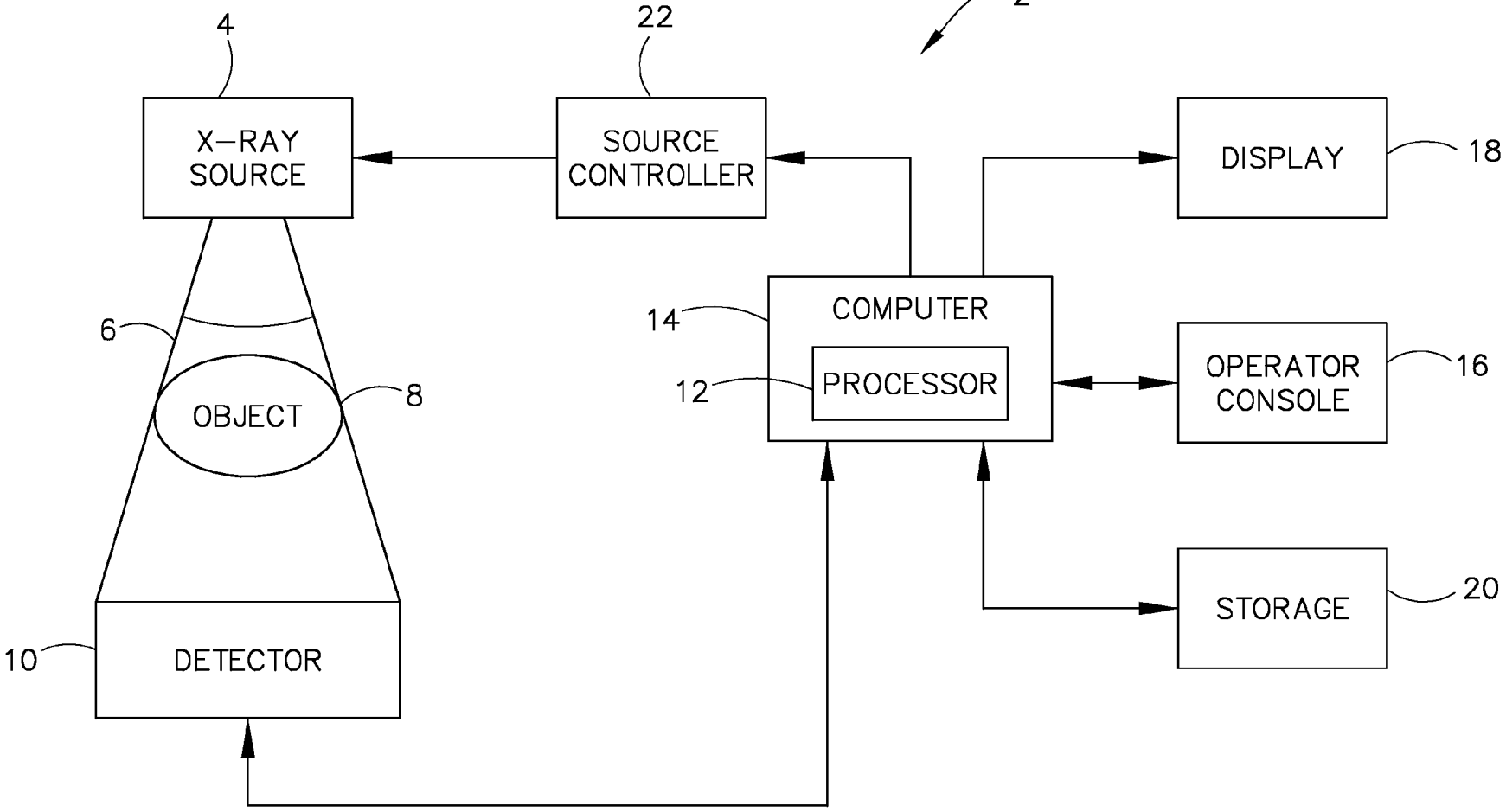
FIG. 1 is a block diagram of an imaging system that can benefit from incorporation of an embodiment of the invention.

FIG. 1 is a block diagram of an embodiment of an x-ray imaging system 2 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of imaging system 2 is merely an example of one such implementation and is not intended to be limiting in terms of modality.

As shown in FIG. 1, imaging system 2 includes an x-ray tube or source 4 configured to project a beam of x-rays 6 through an object 8. Object 8 may include a human subject, pieces of baggage, or other objects desired to be scanned. X-ray source 4 may be a conventional x-ray tube producing x-rays having a spectrum of energies that range, typically, from 30 keV to 200 keV. The x-rays 6 pass through object 8 and, after being attenuated by the object, impinge upon a detector 10. Each detector in detector 10 produces an analog electrical signal that represents the intensity of an impinging x-ray beam, and hence the attenuated beam, as it passes through the object 8. In one embodiment, detector 10 is a scintillation based detector, however, it is also envisioned that direct-conversion type detectors (e.g., CZT detectors, etc.) may also be implemented.

A processor 12 receives the signals from the detector 10 and generates an image corresponding to the object 8 being scanned. A computer 14 communicates with processor 12 to enable an operator, using operator console 16, to control the scanning parameters and to view the generated image. That is, operator console 16 includes some form of operator interface, such as a keyboard, mouse, voice activated controller, or any other suitable input apparatus that allows an operator to control the imaging system 2 and view the reconstructed image or other data from computer 14 on a display unit 18. Additionally, operator console 16 allows an operator to store the generated image in a storage device 20 which may include hard drives, flash memory, compact discs, etc. The operator may also use operator console 16 to provide commands and instructions to computer 14 for controlling a source controller 22 that provides power and timing signals to x-ray source 4.

Figure 2:
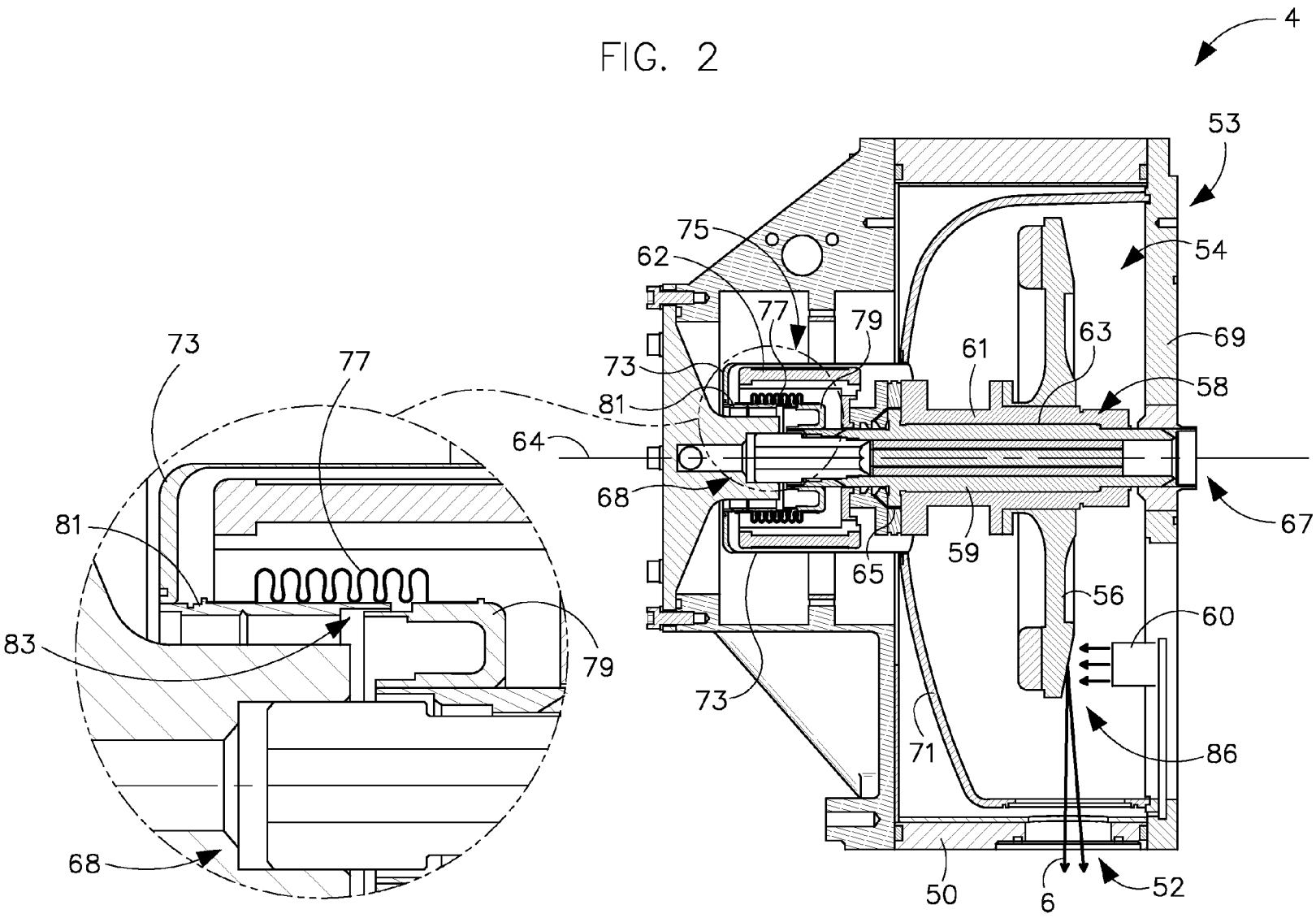
FIG. 2 illustrates a cross-sectional view of an x-ray tube illustrating an embodiment of the invention.

FIG. 2 illustrates a cross-sectional view of an x-ray tube 4 that can benefit from incorporation of an embodiment of the invention. The x-ray tube 4 includes a casing 50 having a radiation emission passage 52 formed therein. The casing 50 partially houses an insert 53 that encloses vacuum 54 having an anode, target (or rotating subsystem) 56, a bearing assembly 58, a cathode 60, and a rotor 62. Bearing assembly 58 is illustrated as a spiral groove bearing (SGB) having an inner shaft 59 and an outer shaft 61. However, the invention is not to be so limited and may include other bearings, such as conventional ball bearings having front and rear, inner and outer races as well, as an example.

X-rays 6 are produced when high-speed electrons from a primary electron beam are suddenly decelerated when directed from the cathode 60 to the target 56 via a potential difference therebetween. In high voltage CT applications, the potential difference between the cathode 60 and target 56 may be, for example, 60 thousand volts (keV) and up to 140 keV or more. In other applications, the potential difference may be lower. The electrons impact a material layer or target focal track 86 at a focal spot or point and x-rays 6 emit therefrom. The point of impact at focal point 61 is typically referred to in the industry as the focal spot. The x-rays 6 emit through the radiation emission passage 52 toward a detector array, such as detector 10 of FIG. 1. In high voltage CT applications, to avoid overheating target 56 from the electrons, target 56 is rotated at a high rate of speed about a centerline 64 (or rotating axis of the shaft) at, for example, 75-250 Hz. In lower voltage or power applications the target 56 may remain stationary.

Bearing assembly 58 includes stationary inner shaft 59 and rotatable outer shaft 61 and, in the illustrated embodiment includes a gap 63 therebetween. Gap 63 is filled with a liquid metal such as gallium, and the gallium is maintained in gap 63, as known in the art, using spiral grooves (not shown) on inner and outer surfaces of respective outer shaft 61 and inner shaft 59. Outer shaft 61 includes an axial limiter or thrust bearing 65 that limits or prevents axial motion of outer shaft 61 and therefore of target 56. Inner shaft 59 is supported on a first end 67 by a supporting plate which, as stated, is stationary with respect to target 56. Inner shaft 59 is also supported on a second end 68, therefore the rotating subsystem target 56 is supported at both front and rear ends, causing solid support or 'straddle' to form the mechanical support of the rotating subsystem target 56 during operation. The straddle support provides smaller mechanical system deflection in contrast to conventional x-ray tube design in which the rotating subsystem target 56 is supported only on one axial end of outer shaft 61.

X-ray tube 4 includes a support plate 69, a frame 71, and a rotor can 73, in part forming vacuum 54 in which the target 56, outer shaft 61, and rotor 62 of the rotating subsystem are positioned. Because inner shaft 59, support plate 69, frame 71, and rotor can 73 are hard-connected (i.e., physically hard-attached to one another by weld, braze or by a combination of both), it can be understood by one skilled in the art that, if rotor can 73 were also hard-connected to inner shaft 59, then temperature changes due to operation and/or processing of x-ray tube 4 can build enormous stresses between components and component interfaces. Such stresses can lead to component and component interfaces distortion and failure, as stated above.

As such, according to the invention, a thermal compensator assembly 75 is included in which a compensator 77 is used to allow for axial expansion and contraction of components of x-ray tube 4. Thermal compensator 77 is coupled to the frame by direct attachment in one embodiment, and formed as a frame component in another embodiment, as examples. According to one embodiment, thermal compensator 77 is coupled to a target support shaft by a rotor can or other component attachment. Thermal compensator 77 in this embodiment and subsequent embodiments has low mechanical stiffness and allows component thermal induced strains or displacement without high internal and interface component stresses, with a main structural support thru the casing structure in order to improve X ray tube reliability and performance. Thus, the main mechanical load path of the rotating subsystem is thru the casing support structure by a coupling component or shaft adapter and not thru the other tube components or thermal compensator to improve component reliability and tube performance. As such, mechanical stresses therein are significantly reduced as a result of the thermal compensator 77.

The thermal compensator 77 can be manufactured by forming a convolution into a thin wall component (or tube) or by welding individual convolutions together forming a welded assembly. Material selection depends upon mechanical (stiffness and allowable stress and temperature) and weldability or brazebility requirements but must be ultra high vacuum compatible such stainless steels for high voltage applications.

The thermal compensator 75 may be formed or manufactured (assembled) in a number of fashions, according to the invention. According to one embodiment, illustrated in FIG. 2, compensator 77 is mechanically coupled to second tube end 68 and to the rotating subsystem inner shaft 59 via a first fitting 79 (shaft end fitting), and compensator 77 is mechanically coupled to a second fitting 81 (rotor end fitting). In this embodiment, first and second fittings 79, 81 can move or slideably engage with respect to one another because a clearance 83 is formed therebetween. That is, first and second fittings 79, 81 can move axially with respect to one another, allowing for axial expansion of components, while maintaining vacuum because compensator 77 is hard-connected (having vacuum integrity) providing boundary closure for the vacuum space.

In other words, in the embodiment illustrated in FIG. 2, during operation and during manufacturing of x-ray tube 4, high stresses are avoided within components thereof because of low mechanical axial stiffness provided by the thermal compensator 75 having a compensator 77. Thus, the rotating subsystem: including but not limited to target 56, outer shaft 61 and rotor 62—and cathode 60 are contained within vacuum 54, and vacuum 54 is formed as an enclosure that includes portions of support plate 69, frame 71, rotor can 73, first and second compensator fittings 79, 81, and compensator 77. Clearance 83 that is formed between first and second fittings 79, 81 thus allows essentially unrestrained axial displacement therebetween that would otherwise cause stresses to build within the portions that form the vacuum enclosure while limiting maximum radial relative motion between the fitting to the clearance 83. Because vacuum integrity to either side of clearance 83 is maintained by compensator 77, x-ray tube 4 may be processed and operated without loss of vacuum integrity and without being overconstrained axially. As such, high stresses that can lead to early or catastrophic failure are avoided.

Thus, according to the embodiment of FIG. 2, frame 71 forms a first portion of the vacuum enclosure having vacuum 54, and rotating subsystem shaft 61 is positioned therein. The frame that forms the vacuum enclosure may also include support plate 69 and/or rotor can 73. In other words, the term 'frame' may specifically refer to frame component 71 or more generally to any component that may be used to form a portion of a vacuum enclosure containing vacuum 54.

FIGS. 3-7 illustrate alternate embodiments of thermal compensator 75 according to embodiments of the invention. FIGS. 3-7 illustrate basic components of x-ray tube 4 and have been simplified for the purposes of illustration. That is, FIGS. 3-7 illustrate sufficient components in the region of second end 68 of shaft, but it is understood that the embodiments of illustrations may be incorporated into x-ray tube 4 of FIG. 2 without restriction, and such may include an SGB or roller bearing assembly, according to embodiments of the invention.

Figure 3:
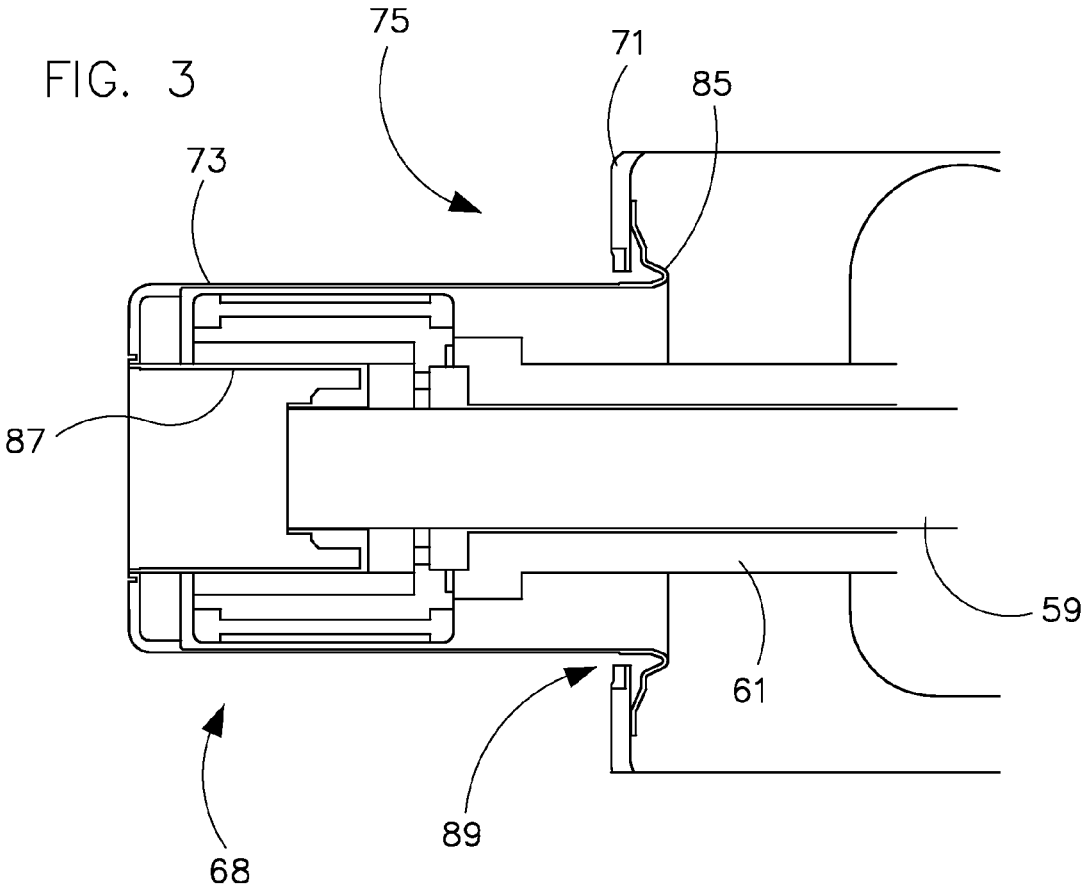
FIG. 3 illustrates a portion of a cross-section of an x-ray tube having a thermal compensator between a frame and rotor can.

Referring to FIG. 3, expansion joint 75 includes a compensator 85 that allows for axial expansion of components. In this embodiment, compensator 85 is attached to frame 71 and rotor can 73. Rotor can 73 is hard connected to inner shaft 59 via a shaft fitting 87. A radial clearance 89 is formed between rotor can 73 and frame 71, and vacuum integrity is maintained across clearance 89 via the compensator 85. Thus, in this embodiment axial expansion and contraction of x-ray tube 4 occurs at thermal compensator joint 75 and vacuum integrity is maintained by compensator 85 that spans clearance 89 while structural support is provided by the casing support 105 by a shaft adapter 104. Because vacuum integrity to either side of clearance 89 is maintained by compensator 85 with a low mechanical axial stiffness, x-ray tube 4 may be processed and operated without loss of vacuum integrity and without being overconstrained axially. As such, high stresses that can lead to early or catastrophic failure are avoided.

Figure 4:
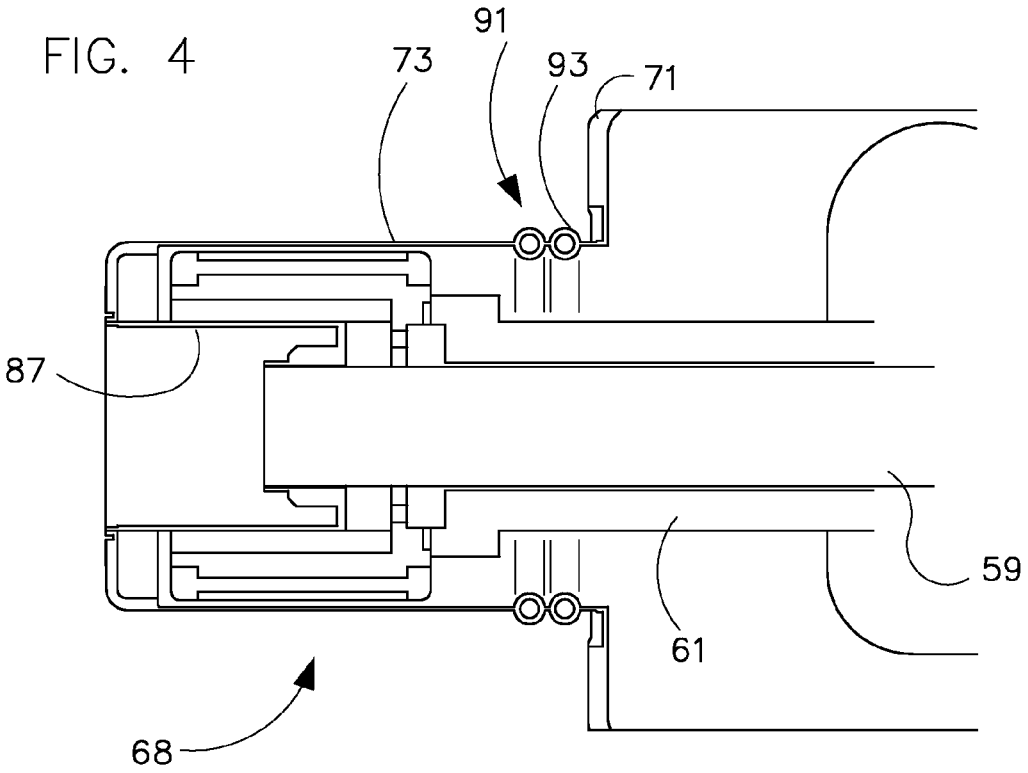
FIGS. 4 and 5 illustrate a portion of a cross-section of an x-ray tube having a thermal compensator along an axial portion of the rotor can.

Referring to FIG. 4, thermal compensator 91 is positioned proximate that illustrated in FIG. 3. However, in this embodiment an expandable compensator 93 allows for axial expansion of components but does not include a clearance for axial displacement between components. That is, in this embodiment, compensator 93 is attached to frame 71 and rotor can 73, and rotor can 73 is itself hard connected (i.e., welded or brazed having vacuum integrity) to frame 71. Rotor can 73 is hard connected to inner shaft 59 via shaft fitting 87. Thus, in this embodiment axial thermal expansion and contraction of x-ray tube 4 occurs at compensator 91 and vacuum integrity is maintained by compensator 93 while casing structure 105 by shaft adapter 104 provides main structural support. Because vacuum integrity is maintained by compensator 93, x-ray tube 4 may be processed and operated without loss of vacuum integrity and without being overconstrained axially. As such, high stresses that can lead to early or catastrophic failure are avoided.

Figure 5:
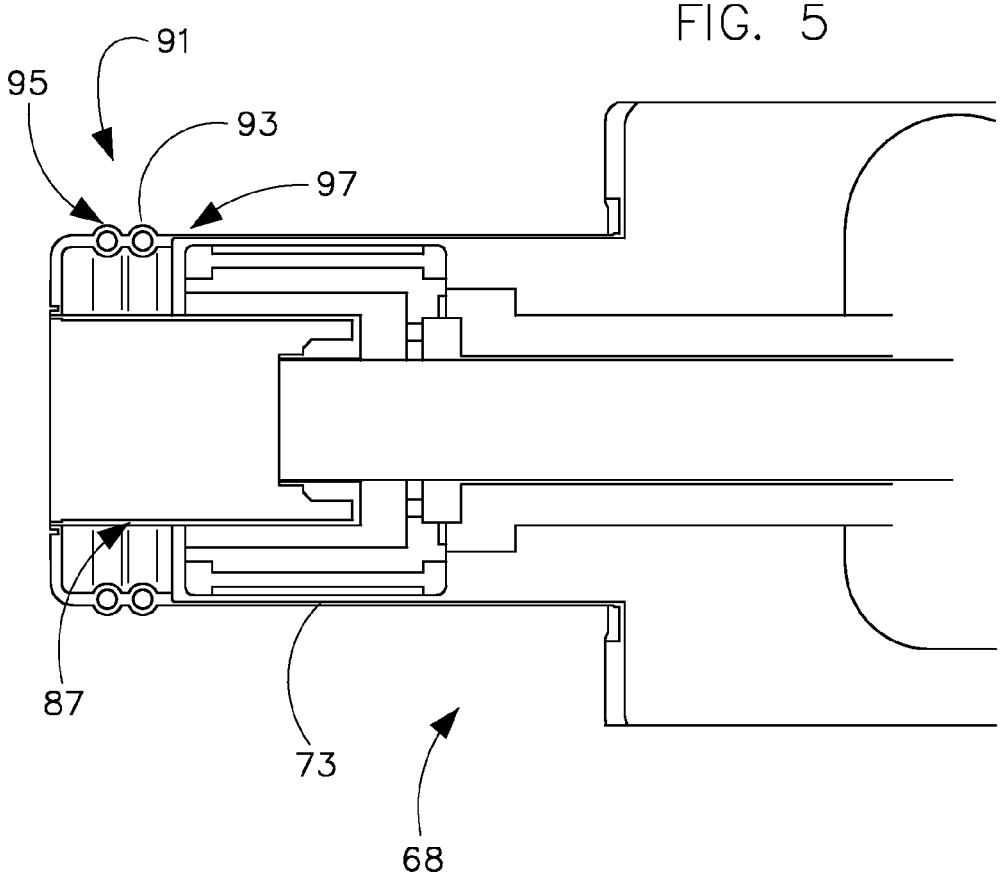

Referring to FIG. 5, the thermal compensator 91 is similar to that of FIG. 4, but positioned on an opposite axial end of rotor can 73 than that of FIG. 4. Embodiment compensator 93 allows for axial expansion of components with no physical axial and radial clearances for displacement between components. In this embodiment, expandable compensator 93 is attached to first and second portions 95, 97 of rotor can 73, and rotor can 73 is itself hard connected (i.e., welded or brazed having vacuum integrity) to frame 71 and shaft end fitting. Rotor can 73 is hard connected to rotating subsystem inner shaft 59 via fitting 87. Thus, in this embodiment axial thermal expansion and contraction of x-ray tube 4 occurs at thermal compensator 75 and vacuum integrity is maintained by compensator 93 while casing structure 105 by a shaft adapter 104 provides main structural support. Because vacuum integrity is maintained by compensator 93, x-ray tube 4 may be processed and operated without loss of vacuum integrity and without being overconstrained axially. As such, high stresses that can lead to early or catastrophic failure are avoided.

Figure 6:
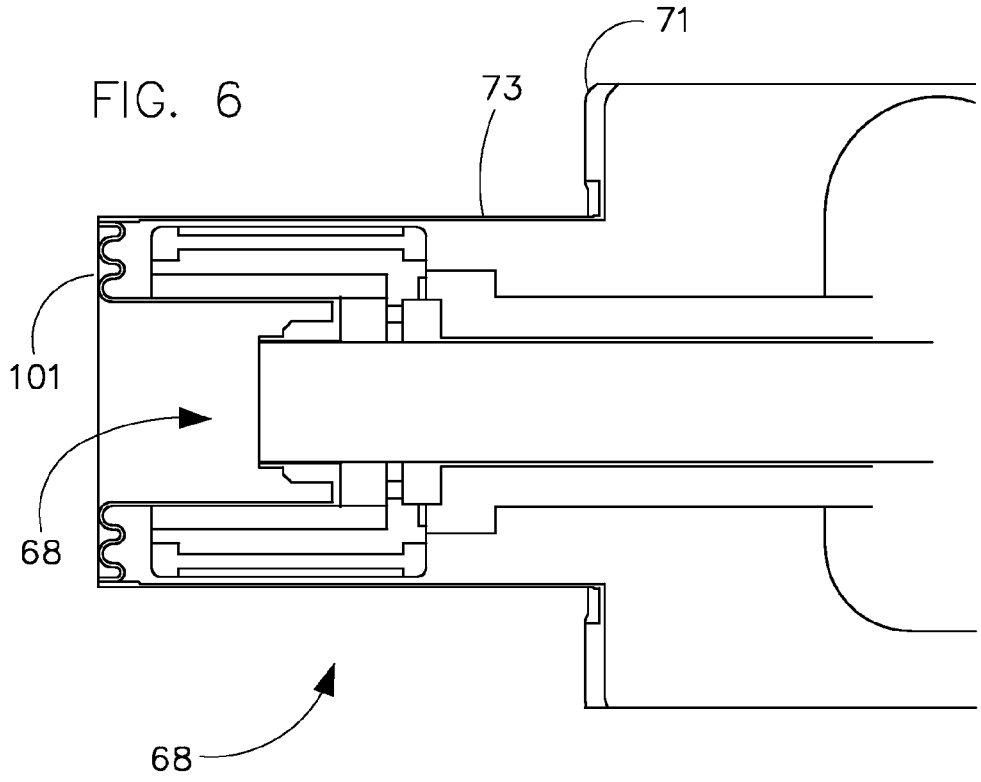
FIGS. 6 and 7 illustrate a portion of a cross-section of an x-ray tube having a thermal compensator as part of a joint between the rotor can and a stationary shaft.
Figure 7:
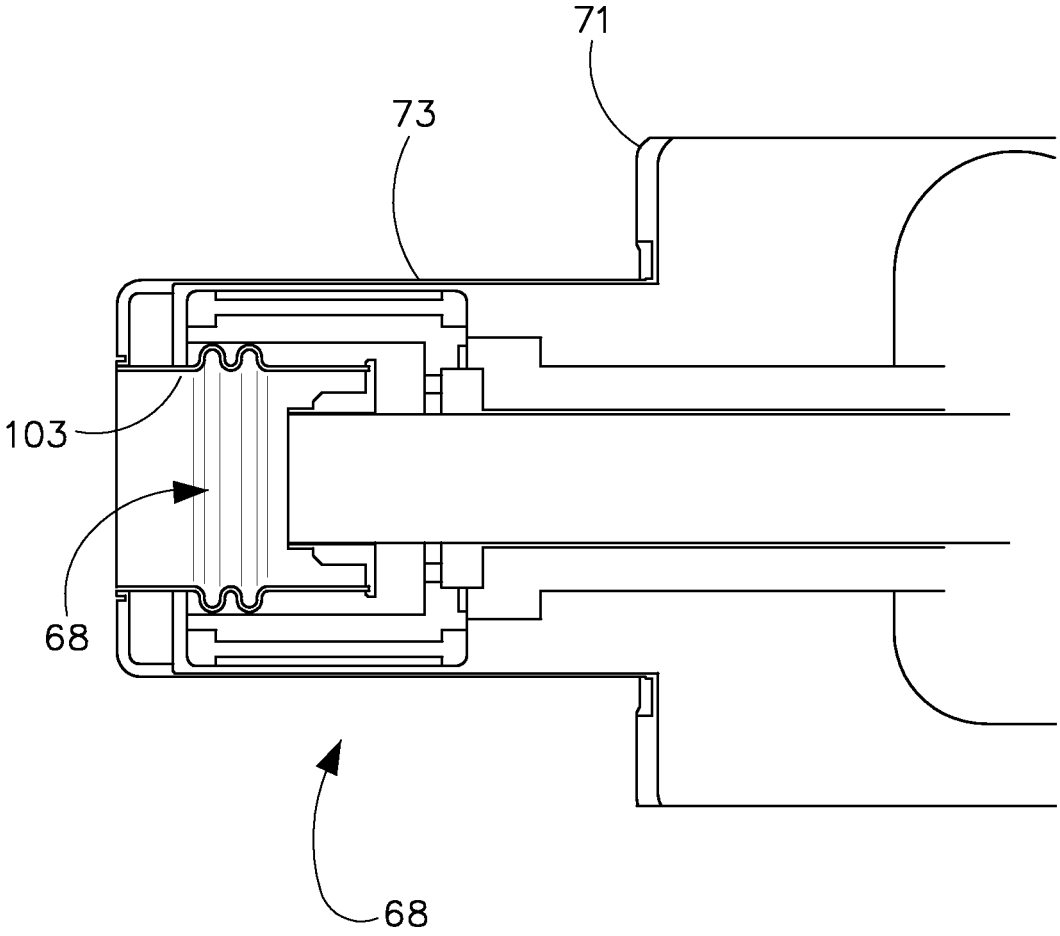

Referring to FIGS. 6 and 7, an expansion joint 99 may include a radially compensator 101 (FIG. 6) or an axially compensator 103 (FIG. 7) that, as with the embodiments of FIGS. 4 and 5, likewise do not include a physical clearance for axial or radial displacements between components but a lower mechanical stiffness (radial stiffness in FIG. 6 and axial stiffness FIG. 7). In these embodiments, thermal compensator 101 and 103 allows for axial expansion of components but also does not include a physical clearance for axial or radial displacement between components. In these embodiments, thermal compensators 101, 103 are formed between rotor can 73 and second end of the rotating subsystem shaft 68. In FIG. 6, thermal compensator 101 is positioned to expand and contract radially, while in FIG. 7 expandable bellows 103 is positioned to expand and contract axially. Rotor can 73 is itself hard connected (i.e., welded or brazed having vacuum integrity) to frame 71. Rotor can 73 is hard connected to rotating subsystem inner shaft 59 via fitting 87. Thus, in these embodiments axial expansion and contraction of x-ray tube 4 occurs at the low mechanical stiffness thermal compensators 101 and 103 and vacuum integrity is maintained by thermal compensator 101 (FIG. 6) and thermal compensator 103 (FIG. 7) while casing support structure 105 by a shaft adapter 104 provides main structural support. Because vacuum integrity is maintained by thermal compensator 101 (FIG. 6) and 103 (FIG. 7), x-ray tube 4 may be processed and operated without loss of vacuum integrity and without being overconstrained axially. As such, high stresses that can lead to early or catastrophic failure are avoided. Of note, although expandable bellows 101 of FIG. 6 is shown extending in a radial direction, it is understood that such ability also accommodates an ability for components of x-ray tube 4 to expand and contract axially as well.

Figure 8:
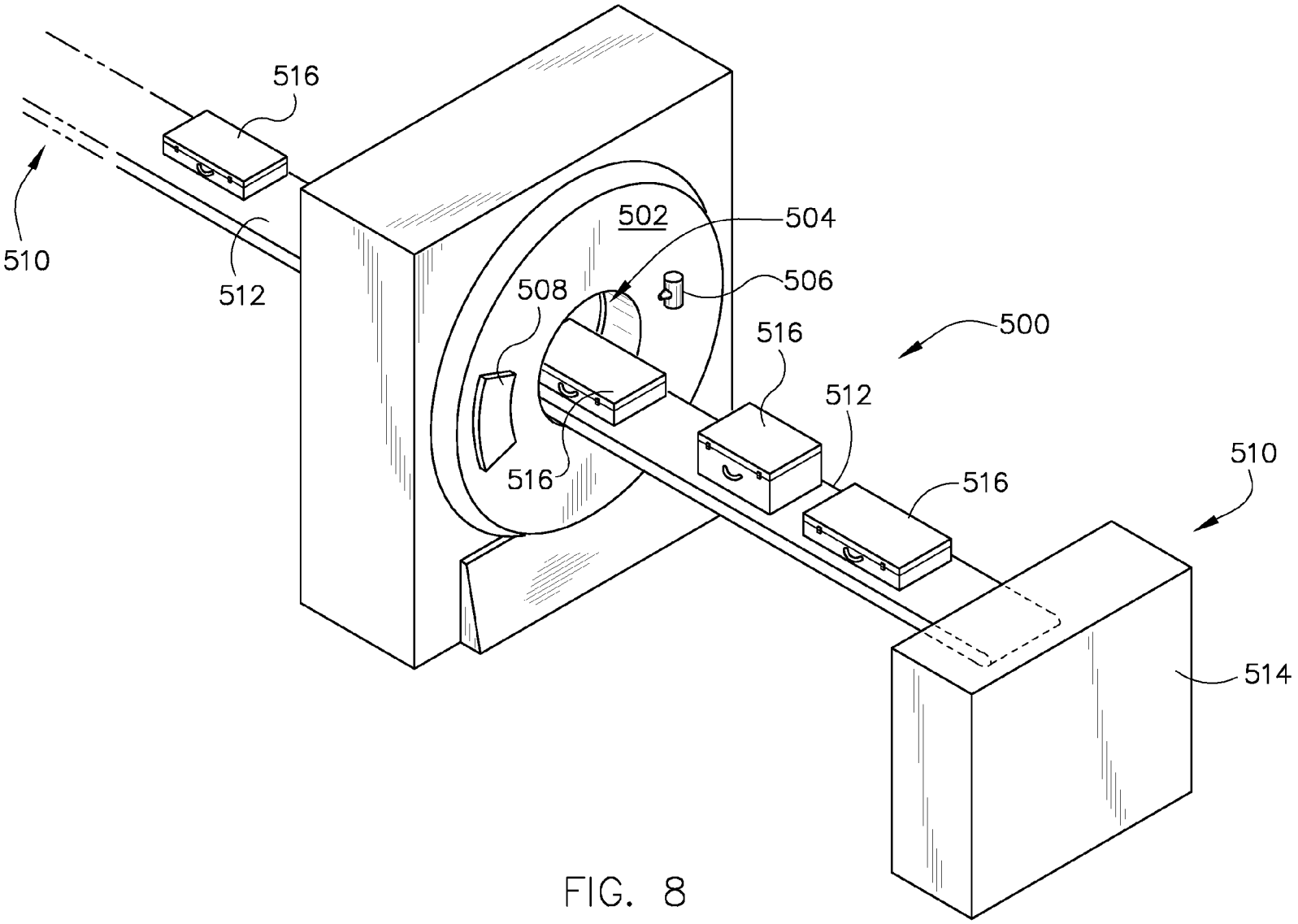
FIG. 8 is a pictorial view of a CT system for use with a non-invasive package inspection system.

FIG. 8 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

According to an embodiment of the invention, an x-ray tube includes a frame forming a first portion of a vacuum enclosure, a rotating subsystem shaft positioned within the vacuum enclosure and having a first end and a second end, wherein the first end of the rotating subsystem shaft is attached to a first portion of the frame, a target positioned within the vacuum enclosure and attached to the rotating subsystem shaft between the first end and the second end, the target positioned to receive electrons from an electron source positioned within the vacuum enclosure, and a thermal compensator mechanically coupled to the second end of the rotating subsystem shaft and to a second portion of the frame, the thermal compensator forming a second portion of the vacuum enclosure.

According to another embodiment of the invention, a method of manufacturing an x-ray tube includes forming a first portion of a vacuum enclosure with a frame, attaching a first end of a rotating subsystem shaft to the frame, coupling a second end of a thermal compensator to the frame, wherein the thermal compensator forms a second portion of the vacuum enclosure, and mechanically coupling a first end of the thermal compensator to a second end of the target support shaft by the rotor can or other component attachment.

Yet another embodiment of the invention includes an imaging system that includes a support structure, a detector attached to the support structure, and an x-ray tube attached to the support structure. The x-ray tube includes a vessel forming a portion of a vacuum enclosure, a rotating subsystem shaft positioned within the vacuum enclosure and having a first end and a second end, wherein the first end of the shaft is attached to a portion of the vessel, a target in the vacuum enclosure that is attached to the rotating subsystem shaft between the first end and second ends, the target positioned to receive electrons from a cathode positioned within the vacuum enclosure, and a thermal compensator mechanically coupled to the second end of the shaft and to another portion of the vessel, the compensator forming another portion of the vacuum enclosure.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a frame forming a first portion of a vacuum enclosure;

a rotating subsystem shaft positioned within the vacuum enclosure and having a first end and a second end, wherein the first end of the rotating subsystem shaft is attached to a first portion of the frame;

a target positioned within the vacuum enclosure and attached to the rotating subsystem shaft between the first end and the second end, the target positioned to receive electrons from an electron source positioned within the vacuum enclosure; and a thermal compensator mechanically coupled to the second end of the rotating subsystem shaft and to a second portion of the frame, the thermal compensator forming a second portion of the vacuum enclosure;

wherein the first and second portions of the vacuum enclosure formed by the frame and the thermal compensator, respectively, interact with one another to maintain a vacuum in the vacuum enclosure; and wherein the second portion of the frame is a rotor can, such that the thermal compensator is coupled to the rotor can.

2. The x-ray tube of claim 1 comprising:

a first compensator fitting attached to the second end of the rotating subsystem shaft and to a first end of the thermal compensator; and a second compensator fitting attached to the rotor can and to a second end of the thermal compensator;

wherein the first and second compensator fittings are spaced apart so as to form a clearance that enables axial movement therebetween, with the thermal compensator extending across the clearance between the first and second compensator fittings.

3. The x-ray tube of claim 2 wherein the first and second compensator fittings are configured to slideably engage with respect to one another along an axis of the x-ray tube that is collinear with a rotating axis of the shaft.

4. The x-ray tube of claim 1 wherein:

the thermal compensator is attached to a first end of the rotor can and to the second portion of the frame;

the first end of the rotor can is configured to slideably engage through an opening of the second portion of the frame; and a second end of the rotor can is attached to the second end of the rotating subsystem shaft via an attachment piece.

5. The x-ray tube of claim 1 wherein:

a first end of the thermal compensator is attached to the rotor can; and a second end of the thermal compensator is attached to the second end of the rotating subsystem shaft via an attachment piece.

6. The x-ray tube of claim 1 wherein the frame comprises a support plate that comprises the first portion of the frame.

7. A method of manufacturing an x-ray tube comprising:

forming a first portion of a vacuum enclosure with a frame;

attaching a first end of a rotating subsystem shaft to the frame;

coupling a second end of a thermal compensator to the frame, wherein the thermal compensator forms a second portion of the vacuum enclosure; and mechanically coupling a first end of the thermal compensator to a second end of a target support shaft by a rotor can or other component attachment;

wherein the thermal compensator is formed as a convoluted component that is expandable so as to interact with the frame to maintain a vacuum in the vacuum enclosure.

8. The method of claim 7 wherein the frame comprises a support plate and a rotor can, and the first end of the rotating subsystem support shaft is attached to the support plate.

9. The method of claim 8 comprising:

mechanically coupling the first end of the thermal compensator to the second end of the rotating subsystem support shaft by attaching a first compensator fitting to a second end of the rotating subsystem support shaft and to a first end of the compensator; and attaching a second compensator fitting to the rotor can, wherein the second end of the thermal compensator is attached to the second compensator fitting.

10. The method of claim 9 wherein one of the first and second compensator fittings is configured to slideably engage the other of the first and second compensator fittings along an axis of the x-ray tube that is collinear with a rotating axis of the shaft.

11. The method of claim 8 wherein mechanically coupling the first end of the compensator to the second end of the shaft comprises:

attaching the first end of the thermal compensator to the rotor can; and attaching the second end of the thermal compensator to a second portion of the frame;

wherein one end of the rotor can is configured to slideably engage through an opening of the second portion of the frame.

12. The method of claim 8 wherein:

the first end of the thermal compensator is attached to the second end of the rotating subsystem support shaft via a fitting; and the second end of the compensator is attached to the rotor can.

13. An imaging system comprising:

a support structure;

a detector attached to the support structure;

an x-ray tube attached to the support structure, the x-ray tube comprising:

a vessel forming a portion of a vacuum enclosure;

a rotating subsystem shaft positioned within the vacuum enclosure and having a first end and a second end, wherein the first end of the shaft is attached to a portion of the vessel;

a target in the vacuum enclosure that is attached to the rotating subsystem shaft between the first end and second ends, the target positioned to receive electrons from a cathode positioned within the vacuum enclosure; and a thermal compensator assembly mechanically coupled to the second end of the shaft and to another portion of the vessel so as to form another portion of the vacuum enclosure, the thermal compensator assembly comprising:

a thermal compensator; and first and second thermal compensator fittings attached to opposing ends of the thermal compensator, the first and second thermal compensator fittings coupling the thermal compensator to the second end of the shaft and to the another portion of the vessel;

wherein the vacuum enclosure formed by the vessel and the thermal compensator assembly has a vacuum maintained therein based on the coupling of the thermal compensator to the vessel.

14. The imaging system of claim 13 wherein the another portion of the vessel to which the thermal compensator assembly is coupled is a rotor can.

15. The imaging system of claim 13 wherein the first and second thermal compensator fittings are configured to slideably engage with respect to one another along an axis of the x-ray tube that is collinear with a rotating axis of the shaft.

16. The imaging system of claim 14 wherein:

the thermal compensator is attached to a first end of the rotor can and to the another portion of the vessel to which the compensator is coupled;

the first end of the rotor can is configured to slideably engage through an opening of the another portion of the vessel to which the compensator is coupled; and a second end of the rotor can is attached to the second end of the shaft via an attachment piece.

17. The imaging system of claim 14 wherein:

a first end of the thermal compensator is attached to the rotor can; and a second end of the thermal compensator is attached to the second end of the shaft via an attachment piece.

18. The imaging system of claim 13 wherein the frame comprises a support plate that comprises the first portion of the frame.

19. The x-ray tube of claim 1 wherein the thermal compensator comprises a convoluted component that is expandable so as to interact with the frame to maintain a vacuum in the vacuum enclosure.

* * * * *